US010488779B2

(12) United States Patent
Yoshioka

(10) Patent No.: US 10,488,779 B2
(45) Date of Patent: Nov. 26, 2019

(54) IMAGE FORMING APPARATUS, METHOD FOR FORMING IMAGE, AND NON-TRANSITORY COMPUTER-READABLE STORAGE MEDIUM

(71) Applicant: Ricoh Company, Ltd., Tokyo (JP)

(72) Inventor: Yuu Yoshioka, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/104,386

(22) Filed: Aug. 17, 2018

(65) Prior Publication Data

US 2019/0146367 A1 May 16, 2019

(30) Foreign Application Priority Data

Nov. 13, 2017 (JP) ..... 2017-218254

(51) Int. Cl.
*G03G 15/02* (2006.01)
*G03G 15/16* (2006.01)

(52) U.S. Cl.
CPC ..... *G03G 15/0266* (2013.01); *G03G 15/0283* (2013.01); *G03G 15/1675* (2013.01)

(58) Field of Classification Search
CPC ..... G03G 15/0266; G03G 15/0291; G03G 15/80; G03G 15/1675; G03G 15/1665
See application file for complete search history.

(56) References Cited

U.S. PATENT DOCUMENTS

2008/0031646 A1* 2/2008 Ishibashi ..... G03G 15/0266 399/55
2014/0064751 A1* 3/2014 Kuroiwa ..... G03G 15/55 399/31
2016/0195830 A1 7/2016 Seki et al.
2016/0299452 A1* 10/2016 Kaneko ..... G03G 15/5037

FOREIGN PATENT DOCUMENTS

JP 2011-215650 10/2011
JP 2015-118204 6/2015
JP 2016-126193 7/2016

* cited by examiner

*Primary Examiner* — Walter L Lindsay, Jr.
*Assistant Examiner* — Jessica L Eley
(74) *Attorney, Agent, or Firm* — Xsensus LLP

(57) ABSTRACT

An image forming apparatus includes a charger, a photoconductor, a charging high-voltage power supply, and circuitry. The charging high-voltage power supply supplies a charging bias to the charger and generates an output value feedback voltage representing a voltage value corresponding to an output current value from the charger to the photoconductor. The circuitry extracts a minimum value of the output value feedback voltage based on the output value feedback voltage generated in a given time. The circuitry calculates a maximum gap value between the charger and the photoconductor based on the minimum value. The circuitry calculates an AC voltage value based on the maximum gap value. The circuitry adds the AC voltage value to a DC voltage value to generate and transmit an output value control signal to the charging high-voltage power supply, to cause the charging high-voltage power supply to adjust the charging bias.

15 Claims, 10 Drawing Sheets

IMAGE FORMING APPARATUS, METHOD FOR FORMING IMAGE, AND NON-TRANSITORY COMPUTER-READABLE STORAGE MEDIUM

CROSS-REFERENCE TO RELATED APPLICATIONS

This patent application is based on and claims priority pursuant to 35 U.S.C. § 119(a) to Japanese Patent Application No. 2017-218254, filed on Nov. 13, 2017, in the Japan Patent Office, the entire disclosure of which is hereby incorporated by reference herein.

BACKGROUND

Technical Field

Embodiments of the present disclosure relate to an image forming apparatus, an image forming method, and a non-transitory computer-readable storage medium.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer with a high-voltage charging bias. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, an image is formed on the recording medium.

The charging bias may include a direct current (DC) voltage alone, or the DC voltage and an alternating current (AC) voltage superimposed on the DC voltage. The latter charging bias including the DC voltage and the AC voltage superimposed on the DC voltage is better in uniformly charging the surface of the photoconductor.

SUMMARY

In one embodiment of the present disclosure, a novel image forming apparatus includes a charger, a photoconductor, a charging high-voltage power supply, and circuitry. The charger is supplied with a charging bias including a direct current voltage and an alternating current voltage superimposed on the direct current voltage. The photoconductor has an outer circumferential surface facing the charger via a gap. The charging high-voltage power supply supplies the charging bias to the charger and generates an output value feedback voltage representing a voltage value corresponding to an output current value. The output current value is a value of an electric current output from the charger to the photoconductor. The circuitry extracts a minimum value of the output value feedback voltage based on the output value feedback voltage generated by the charging high-voltage power supply in a given time. The circuitry calculates a maximum gap value based on the minimum value of the output value feedback voltage extracted. The maximum gap value is a value of a maximum gap distance between the charger and the photoconductor. The circuitry calculates an alternating current voltage value based on the maximum gap value calculated. The circuitry adds the alternating current voltage value calculated to a direct current voltage value to generate an output value control signal. The circuitry transmits the output value control signal to the charging high-voltage power supply to cause the charging high-voltage power supply to adjust the charging bias.

Also described is novel method for forming an image in the image forming apparatus and non-transitory, computer-readable storage medium storing a computer-readable product that causes a processor to perform the method for forming an image in the image forming apparatus.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
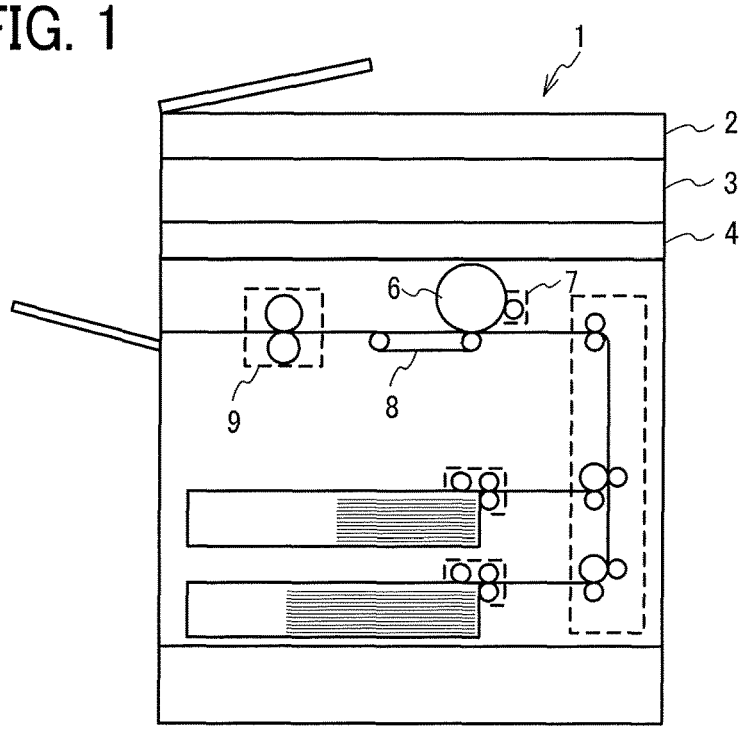
FIG. 1 is a schematic sectional view of an image forming apparatus according to an embodiment of the present disclosure.

In describing embodiments illustrated in the drawings, specific terminology is employed for the sake of clarity. However, the disclosure of the present specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

Referring to the drawings, wherein like reference numerals designate identical or corresponding parts throughout the several views, embodiments of the present disclosure are described below.

According to the embodiments of the present disclosure, a charging bias is adjusted so as not to be excessively supplied to a photoconductor. Accordingly, an outer circumferential surface of the photoconductor is uniformly charged with an appropriate charging bias, allowing an image forming apparatus to form reliable images.

Specifically, the image forming apparatus includes a charger, a photoconductor, a charging high-voltage power supply, and a processor. The charger is supplied with a charging bias that includes a direct current (DC) voltage and an alternating current (AC) voltage superimposed on the DC voltage. The photoconductor has an outer circumferential surface facing the charger via a gap. The charging high-voltage power supply supplies the charging bias to the charger and generates an output value feedback (FB) voltage. The output value FB voltage represents a voltage value corresponding to an output current value, which is a value of an electric current output from the charger to the photoconductor. The processor generates an output value control signal based on the output value FB voltage generated by the charging high-voltage power supply. The processor transmits the output value control signal to the charging high-voltage power supply to control the charging high-voltage power supply. The processor includes a minimum value extraction unit, a maximum gap calculation unit, and AC voltage calculation unit. The minimum value extraction unit extracts a minimum value of the output value FB voltage based on the output value FB voltage generated in a given time. The maximum gap calculation unit calculates a maximum gap value based on the minimum value of the output value FB voltage extracted by the minimum value extraction unit. The maximum gap value is a value of a maximum gap distance between the photoconductor and the charger. The AC voltage calculation unit calculates an AC voltage value based on the maximum gap value calculated by the maximum gap calculation unit. The processor adds the AC voltage value calculated by the AC voltage calculation unit to a DC voltage value to generate the output value control signal. The processor transmits the output value control signal to the charging high-voltage power supply to cause the charging high-voltage power supply to adjust the charging bias.

In particular, the charging bias is adjusted so as not to be excessively supplied to the photoconductor. Accordingly, the charger uniformly charges the outer circumferential surface of the photoconductor with an appropriate charging bias. As a consequence, the image forming apparatus having the above-described configuration forms reliable images.

<First Embodiment>

<Image Forming Apparatus>

Initially with reference to FIG. 1, a description is given of a first embodiment of the present disclosure.

FIG. 1 is a schematic sectional view of an image forming apparatus 1 according to an embodiment of the present disclosure.

The image forming apparatus 1 may be a copier, a facsimile machine, a printer, a multifunction peripheral (MFP) having at least two of copying, printing, scanning, facsimile, and plotter functions, or the like.

Note that the following describes the operation of the image forming apparatus 1 in a copy mode.

As illustrated in FIG. 1, the image forming apparatus 1 includes, e.g., an automatic document feeder (ADF) 2, a scanner 3 serving as an image reader, a writing unit 4, a photoconductor 6, a developing device 7, a transfer belt 8, and a fixing device 9.

In the copy mode, the ADF 2 feeds a plurality of originals to the scanner 3 one by one. The scanner 3 reads image data from each of the plurality of originals.

The writing unit 4 converts, via an image processor, the image data read from each of the plurality of originals into optical data. After the photoconductor 6 is uniformly charged by a charger, the photoconductor 6 is exposed according to optical data from the writing unit 4. Thus, an electrostatic latent image is formed on the photoconductor 6.

The developing device 7 develops the electrostatic latent image on the photoconductor 6 into a visible toner image. As the photoconductor 6 rotates, the toner image is transferred from the photoconductor 6 onto a recording medium conveyed on the transfer belt 8. The fixing device 9 fixes the toner image onto the recording medium. Then, the recording medium bearing the fixed toner image is discharged from a housing of the image forming apparatus 1.

<Electrophotographic Process of Image Forming Apparatus>

Figure 2:
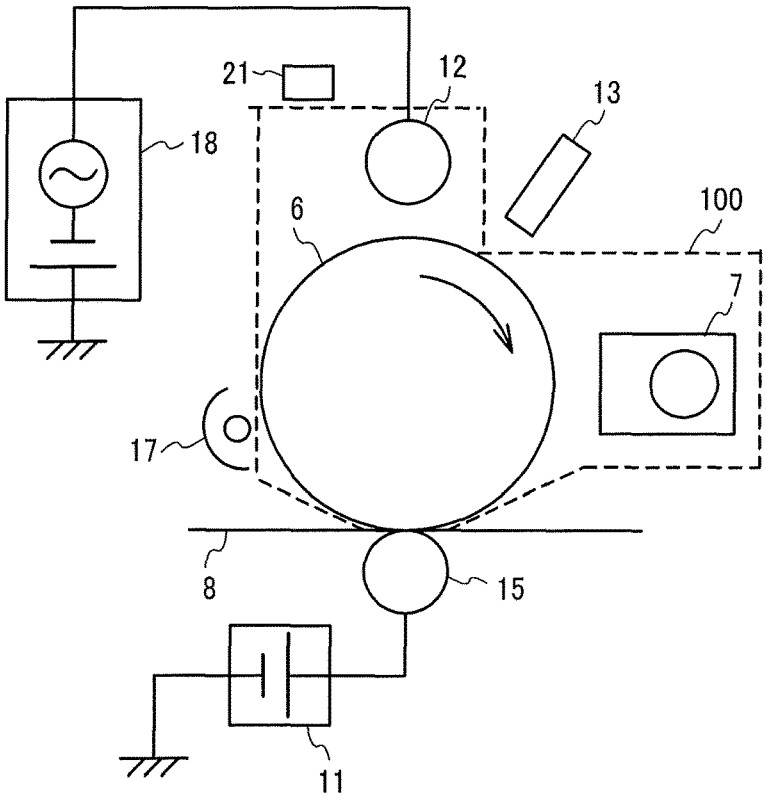
FIG. 2 is a partial view of an image forming apparatus according to a first embodiment of the present disclosure.

Referring now to FIG. 2, a description is given of a configuration and operation of the image forming apparatus 1 to execute an electrophotographic process.

FIG. 2 is a partial view of the image forming apparatus 1 according to the first embodiment of the present disclosure.

FIG. 2 illustrates a configuration of the image forming apparatus 1 employing an indirect transfer system to execute the electrophotographic process. As illustrated in FIG. 2, the image forming apparatus 1 includes a charging high-voltage power supply 18, a high-voltage power supply 11 serving as a primary transfer device, the photoconductor 6, a charging roller 12 serving as a charger, an exposure device 13, the developing device 7, a primary transfer roller 15, the transfer belt 8 (hereinafter referred to as an intermediate transfer belt 8), and a neutralizer 17. The photoconductor 6, the charging roller 12, and the developing device 7 construct a photoconductor unit 100.

The charging high-voltage power supply 18 superimposes an AC voltage on a DC voltage, thereby generating a high-voltage charging bias. The charging high-voltage power supply 18 applies the charging bias to the charging roller 12. The charging roller 12 uniformly charges the photoconductor 6 with the charging bias. Thereafter, the exposure device 13 exposes the photoconductor 6 according to an image signal to form an electrostatic latent image on the photoconductor 6.

Then, the developing device 7 develops the electrostatic latent image with toner, rendering the electrostatic latent image visible as a toner image. The high-voltage power supply 11 generates and applies a DC high voltage to the primary transfer roller 15. The primary transfer roller 15 transfers the toner image from the photoconductor 6 onto the intermediate transfer belt 8 with the DC high voltage.

Then, e.g., a secondary transfer device transfers the toner image from the intermediate transfer belt 8 onto a recording medium. Thereafter, the fixing device 9 fixes the toner image onto the recording medium.

Thus, the image forming apparatus 1 forms a toner image on a recording medium.

After the toner image is transferred from the photoconductor 6, the neutralizer 17 removes electric charges from the surface of the photoconductor 6, rendering the surface of the photoconductor 6 ready for the next charging process.

The image forming apparatus 1 may include four photoconductor units 100 to perform color printing. In such a case, the four photoconductor units 100 employ different colors of toner to form different colors of toner images. After the toner images are transferred onto the intermediate transfer belt 8, the secondary transfer device transfers the toner images onto a recording medium as a composite full-color toner image. The fixing device 9 fixes the full-color toner image onto the recording medium.

Thus, the image forming apparatus 1 forms a color toner image on a recording medium.

As illustrated in FIG. 2, a temperature/humidity sensor 21 is disposed near the photoconductor unit 100. The temperature/humidity sensor 21 measures or detects temperature and humidity. The temperature/humidity sensor 21 outputs, to a processor 24 illustrated in FIG. 3, a temperature/humidity signal indicating data of the temperature and humidity thus detected.

<Hardware Configuration of Image Forming Apparatus>

Figure 3:
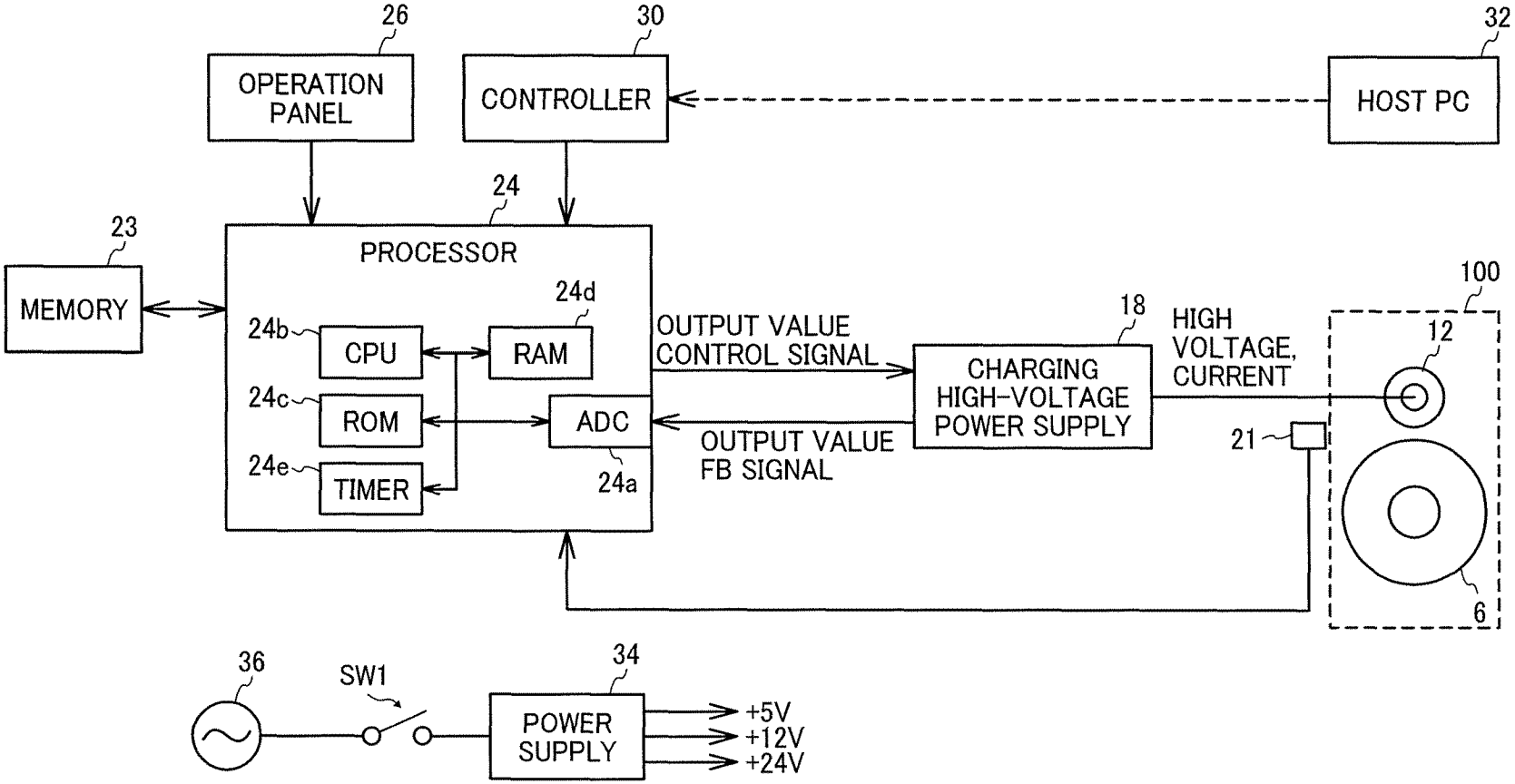
FIG. 3 is a block diagram illustrating a hardware configuration of the image forming apparatus according to the first embodiment of the present disclosure.

Referring now to FIG. 3, a description is given of a hardware configuration of the image forming apparatus 1.

FIG. 3 is a block diagram illustrating a hardware configuration of the image forming apparatus 1 according to the first embodiment of the present disclosure.

The image forming apparatus 1 includes the charging high-voltage power supply 18, the temperature/humidity sensor 21, a memory 23, the processor 24, an operation panel 26, and a controller 30.

The charging high-voltage power supply 18 generates and applies a high voltage to the charging roller 12. Specifically, the charging high-voltage power supply 18 superimposes the AC voltage on the DC voltage, thereby generating the high voltage as a charging bias. The charging high-voltage power supply 18 supplies the charging roller 12 serving as a charger with the charging bias including the DC voltage and the AC voltage superimposed on the DC voltage, and generates an output value feedback (FB) voltage that represents a voltage value corresponding to an output current value, which is a value of an electric current output from the charging roller 12 to the photoconductor 6.

The magnitude of an output voltage from the charging high-voltage power supply 18 is determined according to a pulse-width modulation (PWM) signal, which is an output value control signal sent from the processor 24. Each of the AC voltage and the DC voltage is controllable according to the output value control signal. The charging high-voltage power supply 18 outputs, to the processor 24, an analog output value feedback (FB) signal that indicates an output value FB voltage corresponding to a detected output current from the charging high-voltage power supply 18.

The temperature/humidity sensor 21 disposed near the photoconductor unit 100 outputs temperature and humidity data (i.e., detected temperature and humidity) to the processor 24.

The memory 23 stores, e.g., the temperature and humidity data and a gap distance or gap value G obtained from the output value FB voltage. Note that the gap value G is a value of a gap or space between the photoconductor 6 and the charging roller 12.

The controller 30 controls the entire image forming apparatus 1 according to instructions from a host computer (PC) 32, such as a print job, a printing request (or print instruction), an instruction for completion of printing, energy saving control, a standby notification, a recovery notification, and time management.

The processor 24 outputs the PWM signal as the output value control signal to the charging high-voltage power supply 18.

The processor 24 includes a central processing unit (CPU) **24*b*, a read only memory (ROM) 24*c*, a random access memory (RAM) 24*d*, an analog to digital converter (ADC) 24*a*, and a timer 24*e***.

The CPU **24*b* controls overall operation of the image forming apparatus 1 with the RAM 24*d* as a work memory according to a program stored in advance in the ROM 24*c***.

The ROM **24*c*** is a read-only, non-volatile storage medium that stores firmware and various kinds of data.

The RAM **24*d* is a volatile storage medium capable of high-speed reading and writing information. The RAM 24*d*** is available as a work memory.

The ADC **24*a* converts the output value FB signal, which is an analog electrical signal input from the charging high-voltage power supply 18, to the output value FB voltage, which is digital data. Then, the ADC 24*a* outputs the output value FB voltage to the CPU 24*b***.

Note that the output value FB signal input to the ADC **24*a* is a signal output from the charging high-voltage power supply 18. Here, the charging high-voltage power supply 18 supplies the charging roller 12 with the charging bias of the DC voltage and the AC voltage superimposed on the DC voltage, and generates the output value FB voltage that represents a voltage value corresponding to an output current value, which is a value of an electric current output from the charging roller 12 to the photoconductor 6**. The relationship between the output current value and the output value FB voltage is defined by Equation (1) below:

$$(\text{output value } FB \text{ voltage}) = 0.833 \times (\text{output current value}) \quad \text{Equation (1).}$$

A power supply 34 converts AC power input from an AC power supply 36 into DC power when a switch SW1 is turned on. The power supply 34 supplies the DC power (+5 V, +12 V, +24 V) to electronic circuits provided in the image forming apparatus 1.

<Functional Block Diagram>

Figure 4:
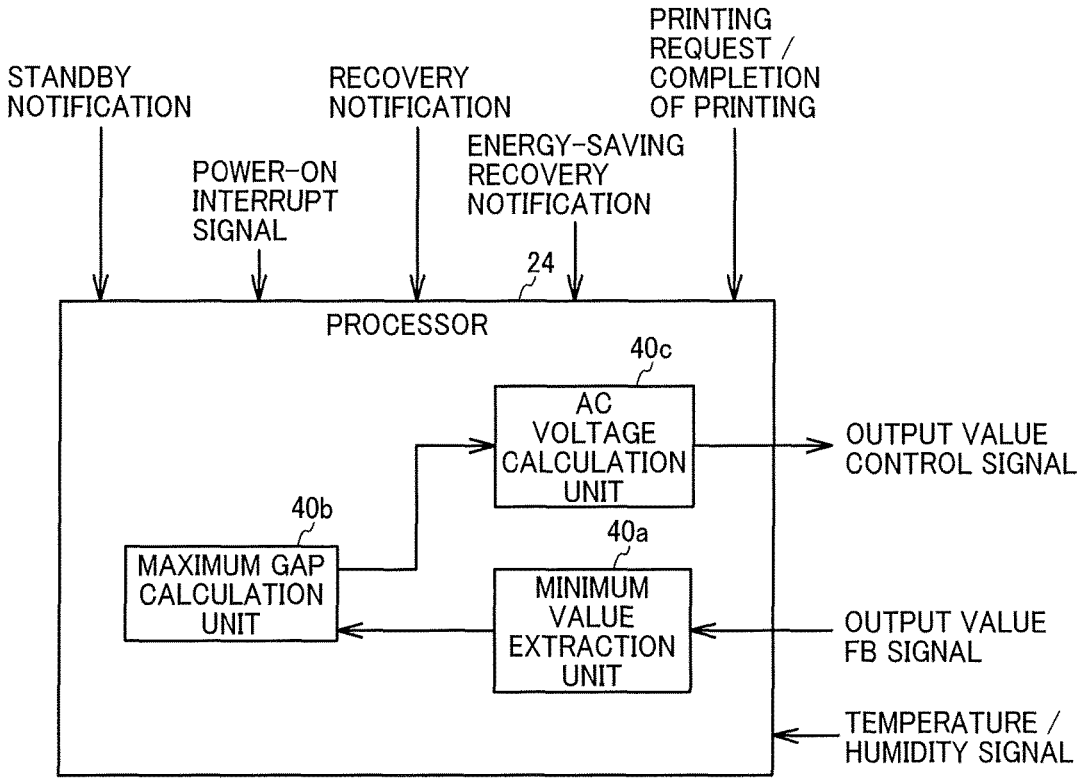
FIG. 4 is a block diagram illustrating a functional configuration of the image forming apparatus according to the first embodiment of the present disclosure.

Referring now to FIG. 4, a description is given of a functional configuration of the image forming apparatus 1.

FIG. 4 is a block diagram illustrating a functional configuration of the image forming apparatus 1 according to the first embodiment of the present disclosure.

The CPU 24*b* illustrated in FIG. 4 reads an operating system (OS) from the ROM 24*c*. The CPU 24*b* loads the OS on the RAM 24*d* to start up the OS. Under control of the OS, the CPU 24*b* reads application software programs (i.e., processing modules) from the ROM 24*c* and executes various kinds of processing. Thus, the processor 24 is implemented as illustrated in FIG. 4.

The processor 24 generates an output value control signal based on an output value FB voltage generated by the charging high-voltage power supply 18. The processor 24 then transmits the output value control signal to the charging high-voltage power supply 18, thereby controlling the charging high-voltage power supply 18. Specifically, an AC voltage calculation unit 40*c* calculates an AC voltage value. The processor 24 adds the AC voltage value to a DC voltage value to generate the output value control signal. The processor 24 transmits the output value control signal to the charging high-voltage power supply 18 to cause the charging high-voltage power supply 18 to adjust the charging bias.

As illustrated in FIG. 4, the processor 24 includes, as processing modules, a minimum value extraction unit 40*a*, a maximum gap calculation unit 40*b*, and the AC voltage calculation unit 40*c*.

The minimum value extraction unit 40*a* extracts a minimum value of the output value FB voltage, based on the output value FB voltage generated in a given time and received through the ADC 24*a*.

The maximum gap calculation unit 40*b* calculates a maximum gap value, which is a value of a maximum gap distance between the photoconductor 6 and the charging roller 12, based on the minimum value of the output value FB voltage extracted by the minimum value extraction unit 40*a*.

Specifically, the maximum gap calculation unit 40*b* calculates the maximum gap value based on the minimum value of the output value FB voltage extracted by the minimum value extraction unit 40*a*, with reference to data indicating a relationship between the voltage value represented by the output value FB voltage and the maximum gap value.

The AC voltage calculation unit 40*c* calculates an AC voltage value based on the maximum gap value calculated by the maximum gap calculation unit 40*b*. The AC voltage calculation unit 40*c* adds the AC voltage value to a DC voltage value, thereby generating an output value control signal. The AC voltage calculation unit 40*c* outputs the output value control signal to the charging high-voltage power supply 18.

Specifically, the AC voltage calculation unit 40*c* calculates the AC voltage value based on the maximum gap value calculated by the maximum gap calculation unit 40*b*, with reference to data indicating a relationship between the maximum gap value and the AC voltage value.

The AC voltage calculation unit 40*c* calculates, as the AC voltage value, a threshold voltage to prevent formation of a defective image having a void.

The processor 24 sequentially executes the minimum value extraction unit 40*a*, the maximum gap calculation unit 40*b*, and the AC voltage calculation unit 40*c*, as a control process B, thereby generating and transmitting the output value control signal to the charging high-voltage power supply 18 to control the charging high-voltage power supply 18 such that the charging high-voltage power supply 18 adjusts the charging bias. In particular, the charging bias is adjusted so as not to be excessively supplied to the photoconductor 6, thereby preventing formation of defective images. Accordingly, the charging roller 12 uniformly charges the outer circumferential surface of the photoconductor 6 with an appropriate charging bias to form reliable images.

<Gap Between Photoconductor and Charging Roller>

Figure 5:
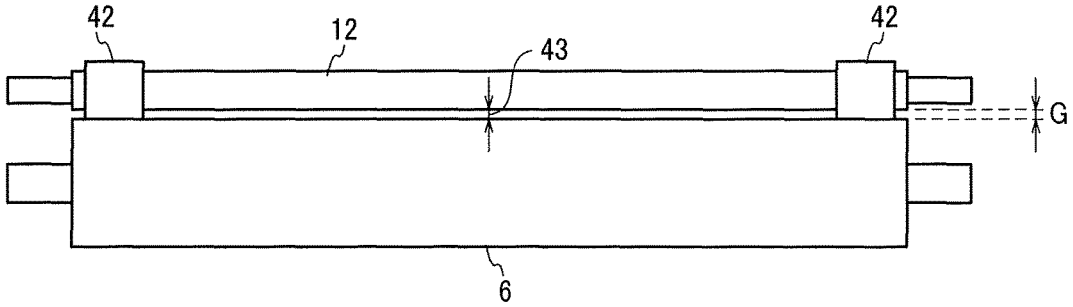
FIG. 5 is a view illustrating a gap between a photoconductor and a charging roller included in a photoconductor unit illustrated in FIG. 2.

Referring now to FIG. 5, a description is given of the gap between the photoconductor 6 and the charging roller 12.

FIG. 5 is a view illustrating the gap between the photoconductor 6 and the charging roller 12 included in the photoconductor unit 100 illustrated in FIG. 2.

The image forming apparatus 1 employs a non-contact charging system. Specifically, as illustrated in FIG. 5, a gap roller pair 42 is interposed between the photoconductor 6 and the charging roller 12 to maintain the photoconductor 6 and the charging roller 12 in a non-contact state. That is, the gap roller pair 42 maintains a small gap 43 between the photoconductor 6 and the charging roller 12. In other words, the surface (i.e., outer circumferential surface) of the photoconductor 6 faces the surface (i.e., outer circumferential surface) of the charging roller 12 via the gap 43.

<Measured Values of Gap Distance>

Figure 6:
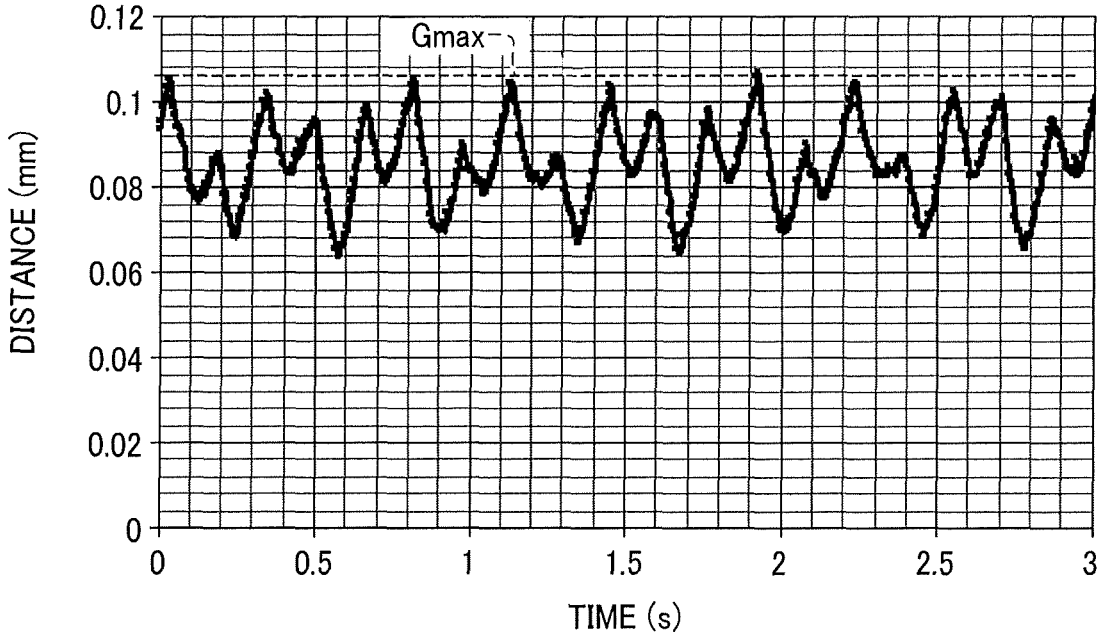
FIG. 6 is a graph illustrating measured values of gap distance between the photoconductor and the charging roller included in the photoconductor unit illustrated in FIG. 2.

Referring now to FIG. 6, a description is given of measured values of gap distance between the photoconductor 6 and the charging roller 12.

FIG. 6 is a graph illustrating the measured values of gap distance between the photoconductor 6 and the charging roller 12 included in the photoconductor unit 100 illustrated in FIG. 2.

FIG. 6 illustrates characteristics of fluctuations in gap value when the photoconductor 6 is rotated, with the gap distance on the vertical axis and the time on the horizontal axis.

As illustrated in FIG. 5, the gap 43 between the photoconductor 6 and the charging roller 12 is maintained in a certain range. Besides, pressure is applied to the photoconductor 6 by, e.g., a cleaning blade that is pressed against the photoconductor 6. Such pressure applied to the photoconductor 6 deforms the photoconductor 6, thereby causing circumferential deflection in the gap distance G between the photoconductor 6 and the charging roller 12.

Due to such deformation of the photoconductor 6, the gap distance G periodically changes in the rotation cycle of the photoconductor 6 and the charging roller 12. Note that a peak or highest value of the amplitude of the gap distance G is herein defined as a maximum gap value Gmax.

<Relationship Between Minimum Value of Output Value FB Voltage and Maximum Gap Value>

Figure 7:
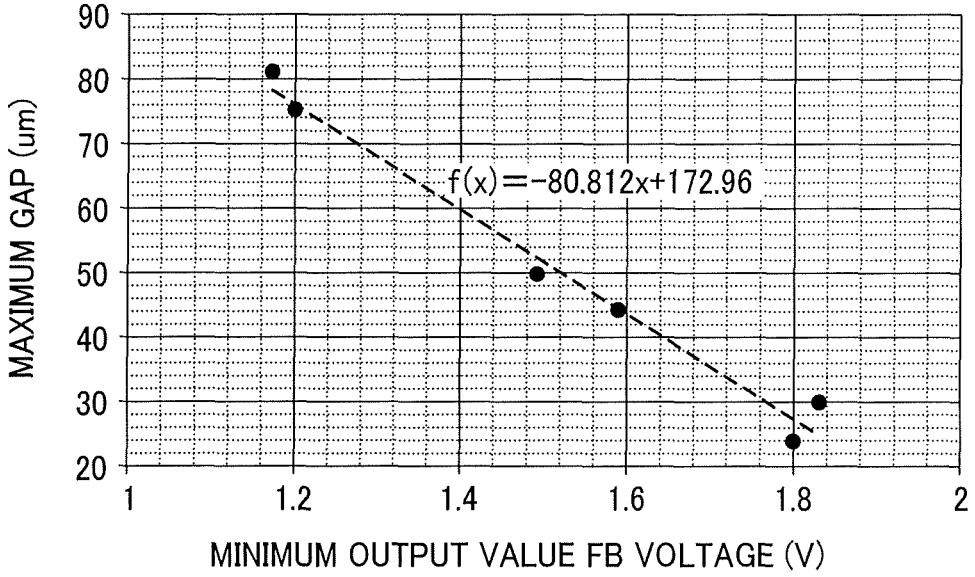
FIG. 7 is a graph illustrating the relationship between the minimum value of an output value feedback voltage of a charging current and the maximum gap value.

Referring now to FIG. 7, a description is given of the relationship between the minimum value of the output value FB voltage and the maximum gap value.

FIG. 7 is a graph illustrating the relationship between the minimum value of the output value FB voltage of a charging current and the maximum gap value.

In FIG. 7, the horizontal axis indicates the minimum output value FB voltage (i.e., the minimum value of the output value FB voltage) while the vertical axis indicates the maximum gap (i.e., the maximum gap value Gmax). The maximum gap value Gmax is obtained with respect to the minimum value of the output value FB voltage by the graph of FIG. 7.

FIG. 7 clarifies a correlation between the maximum gap value Gmax between the photoconductor 6 and the charging roller 12 and the minimum value of the output value FB voltage.

<Relationship Between Maximum Gap Value and Threshold Voltage Against Defective Image with Voids>

Figure 8:
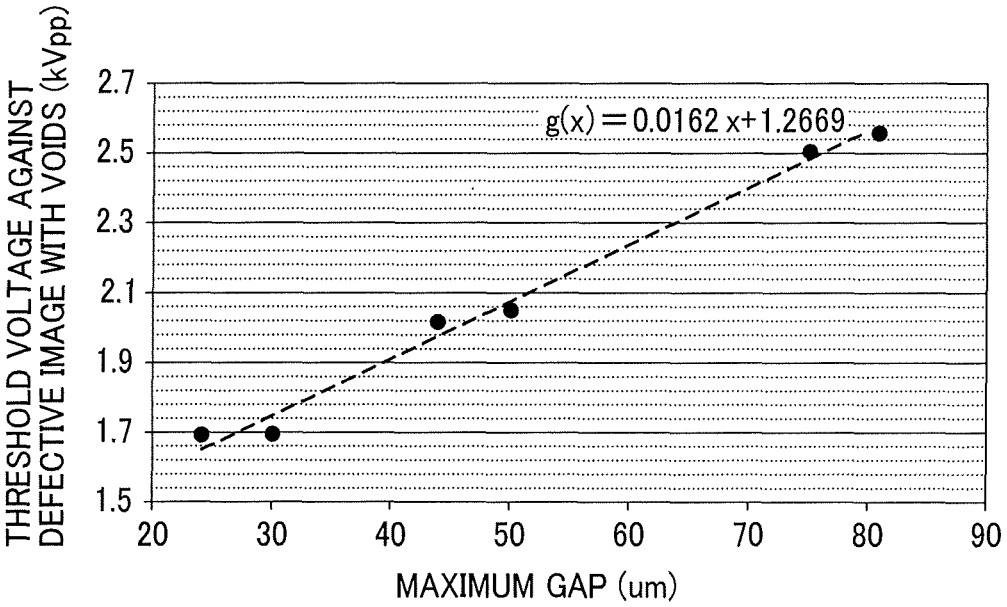
FIG. 8 is a graph illustrating the maximum gap value and the threshold voltage against defective image with voids.

Referring now to FIG. 8, a description is given of the relationship between the maximum gap value and the threshold voltage against defective image with voids.

FIG. 8 is a graph illustrating the maximum gap value and the threshold voltage against defective image with voids.

In FIG. 8, the horizontal axis indicates the maximum gap (i.e., the maximum gap value) while the vertical axis indicates the threshold voltage against defective image with voids. The threshold voltage against defective image with voids is obtained with respect to the maximum gap value by the graph of FIG. 8.

FIG. 8 clarifies a correlation between the maximum gap value and the threshold voltage against defective image with voids. Note that the threshold voltage against defective image with voids means the maximum voltage that does not generate voids in the image.

With reference to FIG. 7, the processor 24 calculates the maximum gap value from a minimum value Y of the output value FB voltage. With reference to FIG. 8, the processor 24 determines the threshold voltage against defective image with voids (i.e., threshold voltage that does not cause imaging failure) from the maximum gap value. According to the threshold voltage thus determined, the processor 24 controls the charging high-voltage power supply 18. That is, the processor 24 determines an optimum AC voltage value that does not cause imaging failure.

<Gap Calculation Control Process>

Figure 9:
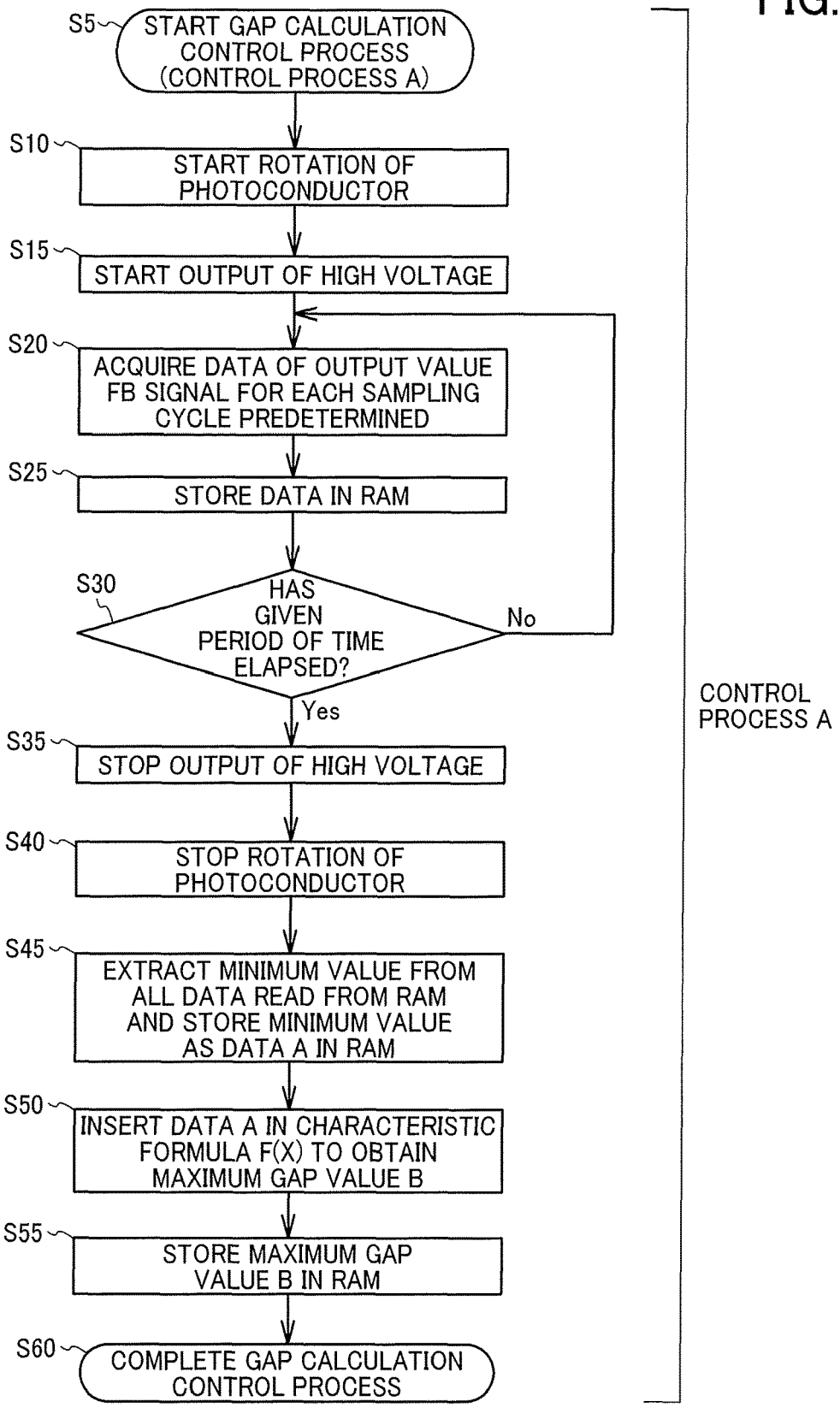
FIG. 9 is a flowchart illustrating a gap calculation control process executed by a processor according to the first embodiment of the present disclosure.

Referring now to FIG. 9, a description is given of a gap calculation control process.

FIG. 9 is a flowchart illustrating the gap calculation control process executed by the processor 24 according to the first embodiment of the present disclosure.

In step S5, the processor 24 starts the gap calculation control process.

In step S10, the processor 24 starts rotation of the photoconductor 6.

In step S15, the processor 24 starts application or output of a high voltage from the charging high-voltage power supply 18. Specifically, as the image forming apparatus 1 starts operating, the processor 24 generates an output value control signal by adding an AC voltage value to a DC voltage value, and outputs the output value control signal to the charging high-voltage power supply 18. The charging high-voltage power supply 18 then outputs and applies a high-voltage charging bias (i.e., DC voltage and AC voltage) to the charging roller 12.

In step S20, the processor 24 acquires, for each sampling cycle (e.g., 10 ms) predetermined, an output value FB voltage as data of the output value FB signal. That is, the ADC 24*a* converts the output value FB signal input from the charging high-voltage power supply 18 into the output value FB voltage, allowing the processor 24 to acquire the output value FB voltage.

In step S25, the processor 24 stores, in the RAM 24*d*, the output value FB voltage, which is the data acquired in step S20.

In step S30, the processor 24 determines whether a given period of time (e.g., time taken for one or more rotations of the photoconductor 6) has elapsed since the charging high-voltage power supply 18 has applied the high voltage to the charging roller 12 in step S15. If the given period of time has not elapsed (NO in step S30), the processor 24 returns to step S20 and repeats the process described above until the given period of time elapses. On the other hand, if the given period of time has elapsed (YES in step S30), the process proceeds to step S35.

In step S35, the processor 24 stops output of the high voltage from the charging high-voltage power supply 18.

In step S40, the processor 24 stops rotation of the photoconductor 6.

In step S45, the processor 24 extracts a minimum value from all data of the output value FB voltage read from the RAM 24*d*, and stores, in the RAM 24*d*, the minimum value of the output value FB voltage as data A.

In step S50, the processor 24 calculates a maximum gap value B. Specifically, the processor 24 substitutes the data A (i.e., the minimum value of the output value FB voltage) for "x" in the following characteristic formula f(x) (i.e., Equation (2)), which is stored in advance in the memory 23, thereby obtaining the maximum gap value B:

$$f(x)=-80.812x+172.96 \quad \text{Equation (2)},$$

where "x" represents the minimum value of the output value FB voltage and f(x) represents the maximum gap value, as illustrated in FIG. 7.

For example, when 1.4 V is the data A (i.e., the minimum value of the output value FB voltage) extracted in step S45, 1.4 is substituted for "x" in the characteristic formula (i.e., Equation (2)) stored in advance in the memory 23. Then, 59.8232 um is obtained as the maximum gap value B.

Note that the memory 23 may store, in advance, data indicating a relationship between the minimum value of the output value FB voltage and the maximum gap value.

Thus, the processor 24 calculates the maximum gap value between the photoconductor 6 and the charging roller 12, based on the minimum value of the output value FB voltage extracted, with reference to the data indicating the relationship between the voltage value represented by the output value FB voltage and the maximum gap value. Accordingly, the accuracy of maximum gap value calculation is enhanced.

In step S55, the processor 24 stores, in the RAM 24*d*, the maximum gap value B calculated in step S50.

In step S60, the processor 24 completes the gap calculation control process.

The control process from steps S5 through S60 is referred to as a control process A.

<Charging Bias Adjustment Control Process>

Figure 10:
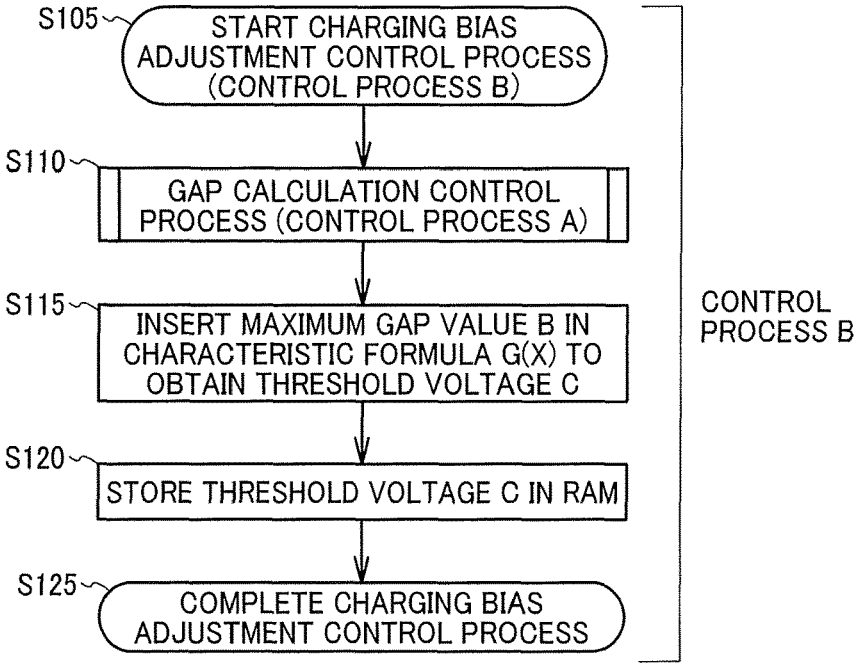
FIG. 10 is a flowchart illustrating a charging bias adjustment control process executed by the processor according to the first embodiment of the present disclosure.

Referring now to FIG. 10, a description is given of a charging bias adjustment control process.

FIG. 10 is a flowchart illustrating the charging bias adjustment control process executed by the processor 24 according to the first embodiment of the present disclosure.

In step S105, the processor 24 starts the charging bias adjustment control process (i.e., control process B).

In step S110, the processor 24 executes the gap calculation control process (i.e., control process A).

In step S115, the processor 24 calculates a threshold voltage C (i.e., threshold voltage against defective image with voids), which is an AC voltage value. Specifically, the processor 24 substitutes the maximum gap value B obtained by execution of the gap calculation control process (i.e., control process A) for "x" in the following characteristic formula g(x) (i.e., Equation (3)), which is stored in advance in the memory 23, thereby obtaining the threshold voltage C:

$$g(x)=0.0162x+1.2669 \quad \text{Equation (3),}$$

where "x" represents the maximum gap value and g(x) represents the threshold voltage against defective image with voids, as illustrated in FIG. 8.

For example, when 59.8232 um is the maximum gap value B obtained by execution of the gap calculation control process in step S110, 59.8232 is substituted for "x" in the characteristic formula (i.e., Equation (3)) stored in advance in the memory 23. Then, 2.2360358 kVpp is obtained as the threshold voltage C, which is an AC voltage value.

Note that the memory 23 may store, in advance, the data indicating the relationship between the maximum gap value and the AC voltage value.

Thus, the processor 24 calculates the AC voltage value based on the maximum gap value, with reference to the data indicating the relationship between the maximum gap value and the AC voltage value. Accordingly, the accuracy of calculating the AC voltage value corresponding to the maximum gap value is enhanced.

In addition, the AC voltage calculation unit 40*c* calculates, as the AC voltage value, the threshold voltage for preventing formation of a defective image having a void. Accordingly, the image forming apparatus 1 does not form such defective images with voids.

In step S120, the processor 24 stores, in the RAM 24*d*, the threshold voltage C (i.e., AC voltage value).

In step S125, the processor 24 completes the charging bias adjustment control process.

The control process from steps S105 through S125 is referred to as the control process B.

Upon activation of the charging high-voltage power supply 18, the processor 24 transmits, to the charging high-voltage power supply 18, the output value control signal that is generated by adding the threshold voltage C (i.e., AC voltage value) read from the RAM 24*d* to a DC voltage value. According to the output value control signal, the charging high-voltage power supply 18 adjusts the charging bias.

As described above, based on an output value FB voltage generated in a given time, the processor 24 extracts a minimum value of the output value FB voltage. Based on the minimum value of the output value FB voltage, the processor 24 calculates a maximum gap value between the photoconductor 6 and the charging roller 12. Based on the maximum gap value, the processor 24 calculates an AC voltage value. The processor 24 adds the AC voltage value to a DC voltage value to generate an output value control signal. The processor 24 outputs or transmits the output value control signal to the charging high-voltage power supply 18 to cause the charging high-voltage power supply 18 to adjust the charging bias. In particular, the charging bias is adjusted so as not to be excessively supplied to the photoconductor 6, thereby preventing formation of defective images. Accordingly, the charging roller 12 uniformly charges the outer circumferential surface of the photoconductor 6 with an appropriate charging bias to form reliable images.

<Second Embodiment>

Figure 11:
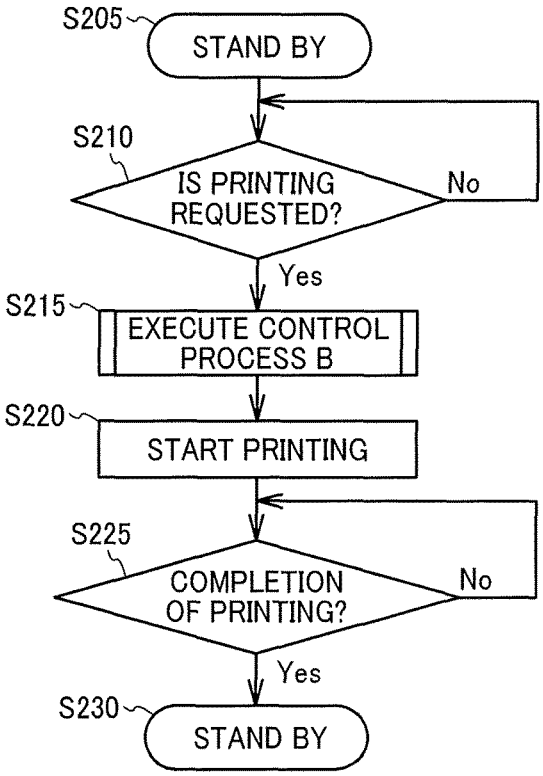
FIG. 11 is a flowchart illustrating a process including the charging bias adjustment control process executed by the processor of the image forming apparatus according to a second embodiment of the present disclosure.

Referring now to FIG. 11, a description is given of the image forming apparatus 1 according to a second embodiment of the present disclosure.

FIG. 11 is a flowchart illustrating a process including the charging bias adjustment control process (i.e., control process B) executed by the processor 24 of the image forming apparatus 1 according to the second embodiment of the present disclosure.

In response to a standby notification from the controller 30, the processor 24 starts a standby process in step S205.

In step S210, the processor 24 determines whether printing including a print job is requested by the controller 30. If the printing including a print job is not requested by the controller 30 (NO in step S210), the processor 24 repeats the determination process of step S210 until the printing is requested. On the other hand, if the printing including a print job is requested by the controller 30 (YES in step S210), the process proceeds to step S215.

In step S215, the processor 24 executes the control process B. That is, the processor 24 executes the control process B in response to a printing request. Here, the processor 24 executes the control process B described above in the first embodiment.

In step S220, the processor 24 executes a print job. In other words, the processor 24 starts printing. Specifically, the processor 24 prints print data included in the print job on a recording medium.

In step S225, the processor 24 determines whether completion of printing is instructed by the controller 30. If the completion of printing is not instructed by the controller 30 (NO in step S225), the processor 24 repeats the determination process of step S225 until the completion of printing is instructed. On the other hand, if the completion of printing is instructed by the controller 30 (YES in step S225), the process proceeds to step S230.

In step S230, the processor 24 returns to a standby status.

Thus, the processor 24 executes the control process B for each printing request to calculate an AC voltage value corresponding to the maximum gap value at the time. Accordingly, the image forming apparatus 1 executes printing operation with an optimum charging bias of a DC voltage and an AC voltage superimposed on the DC voltage.

<Third Embodiment>

Figure 12:
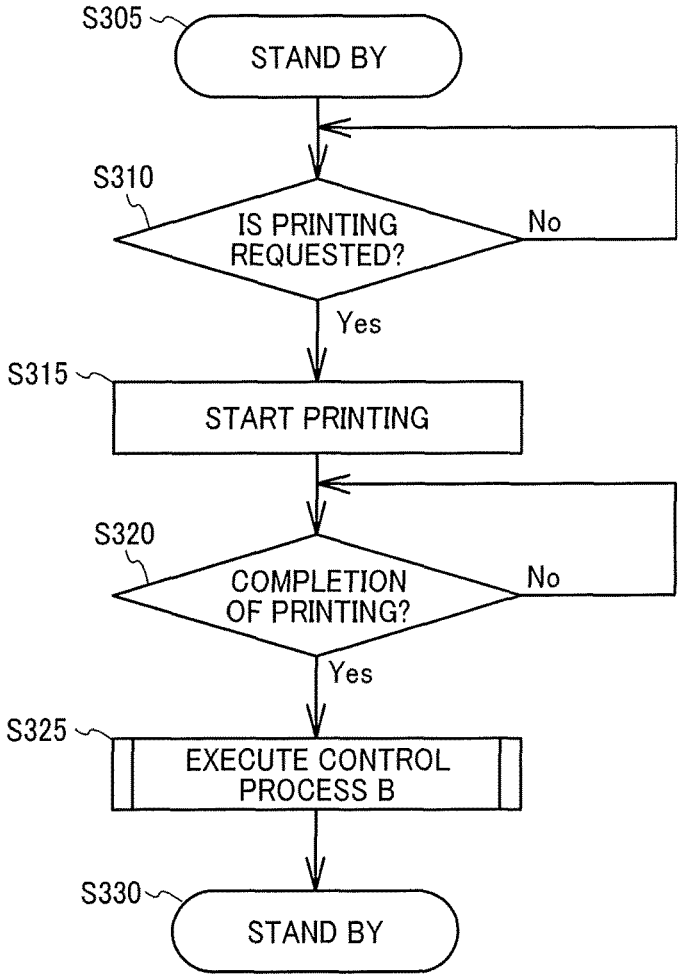
FIG. 12 is a flowchart illustrating a process including the charging bias adjustment control process executed by the processor of the image forming apparatus according to a third embodiment of the present disclosure.

Referring now to FIG. 12, a description is given of the image forming apparatus 1 according to a third embodiment of the present disclosure.

FIG. 12 is a flowchart illustrating a process including the charging bias adjustment control process (i.e., control process B) executed by the processor 24 of the image forming apparatus 1 according to the third embodiment of the present disclosure.

In response to a standby notification from the controller 30, the processor 24 starts a standby process in step S305.

In step S310, the processor 24 determines whether printing including a print job is requested by the controller 30. If the printing including a print job is not requested by the controller 30 (NO in step S310), the processor 24 repeats the determination process of step S310 until the printing is requested. On the other hand, if the printing including a print job is requested by the controller 30 (YES in step S310), the process proceeds to step S315.

In step S315, the processor 24 executes a print job. In other words, the processor 24 starts printing. Specifically, the processor 24 prints print data included in the print job on a recording medium.

In step S320, the processor 24 determines whether completion of printing is instructed by the controller 30. If the completion of printing is not instructed by the controller 30 (NO in step S320), the processor 24 repeats the determination process of step S320 until the completion of printing is instructed. On the other hand, if the completion of printing is instructed by the controller 30 (YES in step S320), the process proceeds to step S325.

In step S325, the processor 24 executes the control process B. That is, the processor 24 executes the control process B in response to completion of printing. Here, the processor 24 executes the control process B described above in the first embodiment.

In step S330, the processor 24 returns to a standby status.

Thus, the processor 24 executes the control process B upon completion of printing, thereby reducing user waiting time.

<Fourth Embodiment>

Figure 13:
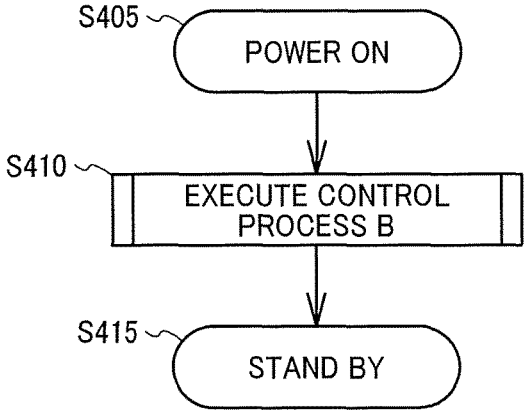
FIG. 13 is a flowchart illustrating a process including the charging bias adjustment control process executed by the processor of the image forming apparatus according to a fourth embodiment of the present disclosure.

Referring now to FIG. 13, a description is given of the image forming apparatus 1 according to a fourth embodiment of the present disclosure.

FIG. 13 is a flowchart illustrating a process including the charging bias adjustment control process (i.e., control process B) executed by the processor 24 of the image forming apparatus 1 according to the fourth embodiment of the present disclosure.

When the switch SW1 is turned on according to manual instruction, the AC power supply 36 supplies AC power to the power supply 34. The power supply 34 then supplies drive power (e.g., +5 V) to the processor 24. In response to the drive power, as described above, the CPU 24*b* illustrated in FIG. 4 reads the OS from the ROM 24*c* and loads the OS on the RAM 24*d* to start up the OS. Under control of the OS, the CPU 24*b* reads application software programs (i.e., processing modules) from the ROM 24*c*. Thus, the processor 24 is implemented as illustrated in FIG. 4.

That is, the power supply 34 transmits a power-on interrupt signal to the processor 24 when the image forming apparatus 1 is powered on. According to the power-on interrupt signal, the processor 24 stars a power-on process in step S405.

In step S410, the processor 24 executes the control process B. That is, the processor 24 executes the control process B in response to power-on. Here, the processor 24 executes the control process B described above in the first embodiment.

In step S415, the processor 24 shifts to a standby status.

Thus, the processor 24 executes the control process B immediately after power-on, during refreshment operation that is different from image forming operation, thereby reducing the user waiting time.

<Fifth Embodiment>

Figure 14:
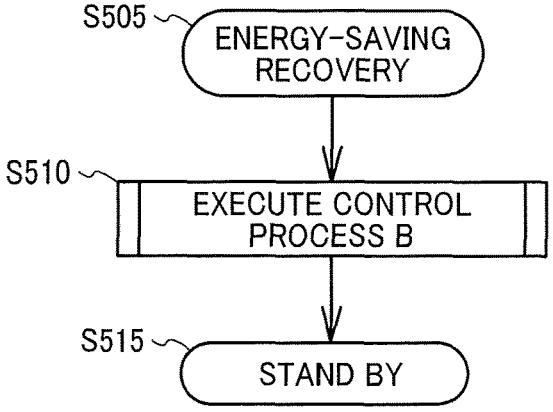
FIG. 14 is a flowchart illustrating a process including the charging bias adjustment control process executed by the processor of the image forming apparatus according to a fifth embodiment of the present disclosure.

Referring now to FIG. 14, a description is given of the image forming apparatus 1 according to a fifth embodiment of the present disclosure.

FIG. 14 is a flowchart illustrating a process including the charging bias adjustment control process (i.e., control process B) executed by the processor 24 of the image forming apparatus 1 according to the fifth embodiment of the present disclosure.

In response to an energy-saving recovery notification from the controller 30, the processor 24 starts an energy-saving recovery process in step S505.

In step S510, the processor 24 executes the control process B. That is, the processor 24 executes the control process B in response to recovery from an energy-saving status. Here, the processor 24 executes the control process B described above in the first embodiment.

In step S515, the processor 24 shifts to a standby status.

Thus, the processor 24 executes the control process B immediately after energy-saving recovery and when the image forming operation is not performed, thereby reducing the user waiting time.

<Sixth Embodiment>

Figure 15:
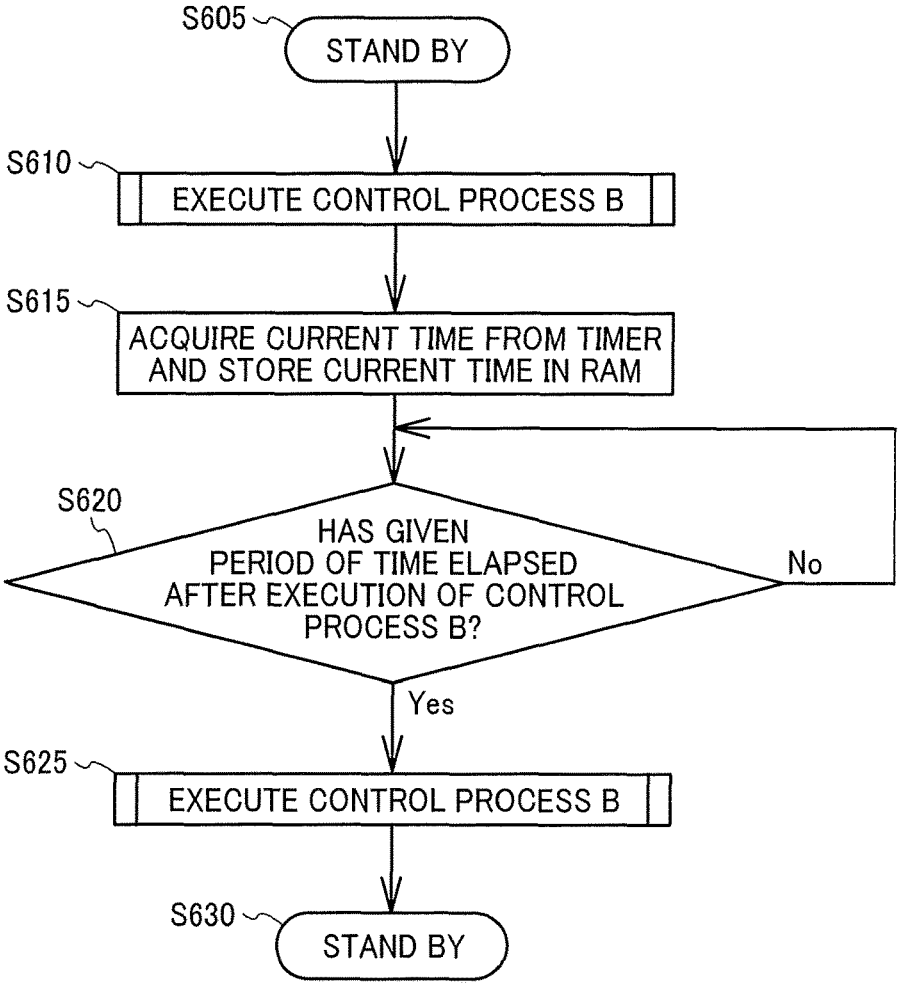
FIG. 15 is a flowchart illustrating a process including the charging bias adjustment control process executed by the processor of the image forming apparatus according to a sixth embodiment of the present disclosure.

Referring now to FIG. 15, a description is given of the image forming apparatus 1 according to a sixth embodiment of the present disclosure.

FIG. 15 is a flowchart illustrating a process including the charging bias adjustment control process (i.e., control process B) executed by the processor 24 of the image forming apparatus 1 according to the sixth embodiment of the present disclosure.

In response to a standby notification from the controller 30, the processor 24 starts a standby process in step S605.

In step S610, the processor 24 executes the control process B. Here, the processor 24 executes the control process B described above in the first embodiment.

In step S615, the processor 24 acquires a current time t1 from the timer 24*e* and stores the current time t1 in the RAM 24*d*.

In step S620, the processor 24 determines whether a given period of time T (e.g., two hours) has elapsed since execution of the control process B in step S610. Specifically, the processor 24 determines whether a difference time (t2−t1) is equal to or greater than the given period of time T, where t1 represents a control process execution time acquired from the RAM 24*d* and t2 represents a current time acquired from the timer 24*e*. Note that the control process execution time is the time when the control process B is executed. The processor 24 calculates the difference time (t2−t1) by subtracting the time t1 from the time t2.

If the difference time (t2−t1) is less than the given period of time T (NO in step S620), in other words, if the given period of time T has not elapsed since the execution of the control process B, the processor 24 repeats the determination process of step S620 until the difference time (t2−t1) is equal to or greater than the given period of time T. On the other hand, if the difference time (t2−t1) is equal to or greater than the given period of time T (YES in step S620), in other words, if the given period of time T has elapsed since the execution of the control process B, the process proceeds to step S625.

In step S625, the processor 24 executes the control process B again. That is, the processor 24 executes the control process B in response to an elapse of the given period of time T since previous execution of the control process B. Here, the processor 24 executes the control process B described above in the first embodiment.

In step S630, the processor 24 returns to a standby status.

Thus, the processor 24 executes the control process B when a given period of time elapses to perform calculation without fluctuations in gap value.

<Seventh Embodiment>

Figure 16:
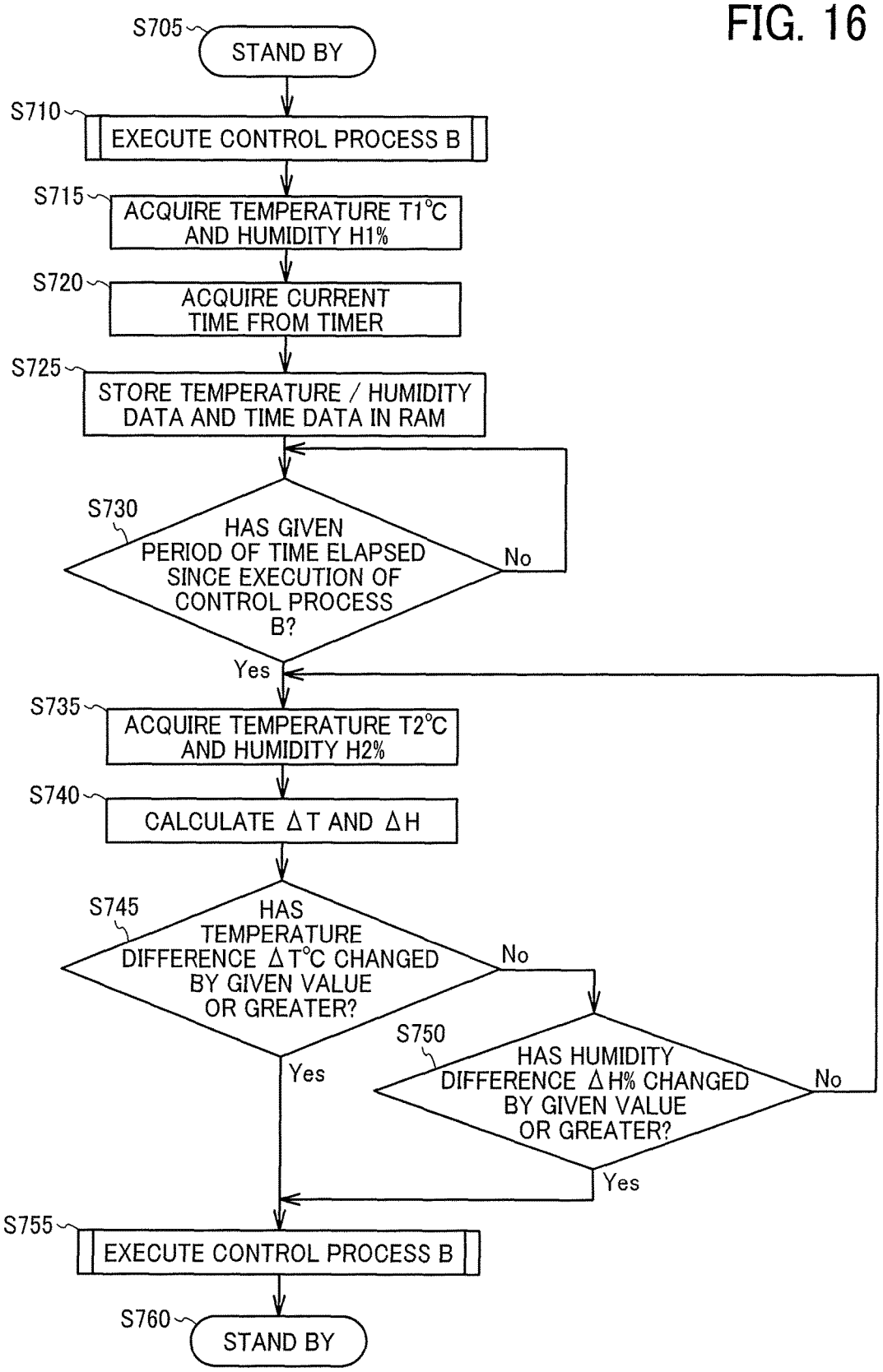
FIG. 16 is a flowchart illustrating a process including the charging bias adjustment control process executed by the processor of the image forming apparatus according to a seventh embodiment of the present disclosure.

Referring now to FIG. 16, a description is given of the image forming apparatus 1 according to a seventh embodiment of the present disclosure.

FIG. 16 is a flowchart illustrating a process including the charging bias adjustment control process (i.e., control process B) executed by the processor 24 of the image forming apparatus 1 according to the seventh embodiment of the present disclosure.

In response to a standby notification from the controller 30, the processor 24 starts a standby process in step S705.

In step S710, the processor 24 executes the control process B. Here, the processor 24 executes the control process B described above in the first embodiment.

In step S715, the processor 24 acquires a temperature T1° C. and a humidity H1% from the temperature/humidity sensor 21.

In step S720, the processor 24 acquires a current time t1 from the timer 24*e*.

In step S725, the processor 24 adds the current time t1 to the temperature T1° C. and the humidity H1% acquired from the temperature/humidity sensor 21, and stores, in the RAM 24*d*, the temperature T1° C. and the humidity H1% with the current time t1.

In step S730, the processor 24 determines whether a given period of time T (e.g., two hours) has elapsed since execution of the control process B in step S710. Specifically, the processor 24 determines whether a difference time (t2−t1) is equal to or greater than the given period of time T, where t1 represents a control process execution time acquired from the RAM 24*d* and t2 represents a current time acquired from the timer 24*e*. Note that the control process execution time is the time when the control process B is executed. The processor 24 calculates the difference time (t2−t1) by subtracting the time t1 from the time t2.

If the difference time (t2−t1) is less than the given period of time T (NO in step S730), in other words, if the given period of time T has not elapsed since the execution of the control process B, the processor 24 repeats the determination process of step S730 until the difference time (t2−t1) is equal to or greater than the given period of time T. On the other hand, if the difference time (t2−t1) is equal to or greater than the given period of time T (YES in step S730), in other words, if the given period of time T has elapsed since the execution of the control process B, the process proceeds to step S735.

In step S735, the processor 24 acquires a temperature T2° C. and a humidity H2% from the temperature/humidity sensor 21.

In step S740, the processor 24 calculates a difference temperature ΔT° C. by subtracting the temperature T1° C. acquired from the RAM 24*d* from the temperature T2° C. Meanwhile, the processor 24 calculates a difference humidity ΔH % by subtracting the humidity H1% acquired from the RAM 24*d* from the humidity H2%.

In step S745, the processor 24 determines whether the difference temperature ΔT° C. has changed by a given value (e.g., 10° C.) or greater. If the difference temperature ΔT° C. has changed by the given value or greater (YES in step S745), the process proceeds to step S755. On the other hand, if the difference temperature ΔT° C. has not changed by the given value or greater (NO in step S745), the process proceeds to step S750.

In step S750, the processor 24 determines whether the difference humidity ΔH % has changed by a given value (e.g., 20%) or greater. If the difference humidity ΔH % has changed by the given value or greater (YES in step S750), the process proceeds to step S755. On the other hand, if the difference humidity ΔH % has not changed by the given value or greater (NO in step S750), the process returns to step S735.

In step S755, the processor 24 executes the control process B. That is, the processor 24 executes the control process B in response to at least one of the temperature and the humidity measured by the temperature/humidity sensor 21 changing by a given value or greater after previous execution of the control process B. Here, the processor 24 executes the control process B described above in the first embodiment.

In step S760, the processor 24 returns to a standby status.

Thus, in response to certain changes in temperature and humidity that may cause expansion of the charging roller 12 and the photoconductor 6, the processor 24 executes the control process B, allowing the image forming apparatus 1 to perform the image forming operation at appropriate voltage.

<Effects and Advantages in Aspects>

The embodiments described above are one example and attain effects and advantages below in a plurality of aspects.

<First Aspect>

According to a first aspect, as illustrated in FIG. 3, an image forming apparatus (e.g., image forming apparatus 1) includes a charger (e.g., charging roller 12), a photoconductor (e.g., photoconductor 6), a charging high-voltage power supply (e.g., charging high-voltage power supply 18), and a processor (e.g., processor 24). The charger is supplied with a charging bias that includes a DC voltage and an AC voltage superimposed on the DC voltage. The photoconductor has an outer circumferential surface facing the charger via a gap (e.g., gap 43). The charging high-voltage power supply supplies the charging bias to the charger and generates an output value FB voltage that represents a voltage value corresponding to an output current value. The output current value is a value of an electric current output from the charger to the photoconductor The processor generates an output value control signal based on the output value FB voltage generated by the charging high-voltage power supply. The processor transmits the output value control signal to the charging high-voltage power supply to control the charging high-voltage power supply. As illustrated in FIG. 4, the processor includes a minimum value extraction unit (e.g., minimum value extraction unit 40*a*), a maximum gap calculation unit (e.g., maximum gap calculation unit 40*b*), and an AC voltage calculation unit (e.g., AC voltage calculation unit 40*c*). The minimum value extraction unit extracts a minimum value of the output value FB voltage based on the output value FB voltage generated in a given time. The maximum gap calculation unit calculates a maximum gap value based on the minimum value of the output value FB voltage extracted by the minimum value extraction unit. The maximum gap value is a value of a maximum gap distance between the charger and the photoconductor. The AC voltage calculation unit calculates an AC voltage value based on the maximum gap value calculated by the maximum gap calculation unit. The processor adds the AC voltage value calculated by the AC voltage calculation unit to a DC voltage value to generate the output value control signal. The processor transmits the output value control signal to the charging high-voltage power supply to cause the charging high-voltage power supply to adjust the charging bias.

According to the present aspect, the minimum value extraction unit extracts the minimum value of the output value FB voltage based on the output value FB voltage generated in the given time. The maximum gap calculation unit calculates the maximum gap value based on the minimum value of the output value FB voltage. The AC voltage calculation unit calculates the AC voltage value based on the maximum gap value. The processor adds the AC voltage value to the DC voltage value to generate the output value control signal. The processor transmits the output value control signal to the charging high-voltage power supply to cause the charging high-voltage power supply to adjust the charging bias. In particular, the charging bias is adjusted so as not to be excessively supplied to the photoconductor, thereby preventing formation of defective images. Accordingly, the charger uniformly charges the outer circumferential surface of the photoconductor with an appropriate charging bias to form reliable images.

<Second Aspect>

According to a second aspect, the maximum gap calculation unit calculates the maximum gap value based on the minimum value of the output value FB voltage extracted by the minimum value extraction unit, with reference to data indicating a relationship between the voltage value represented by the output value FB voltage and the maximum gap value.

According to the present aspect, the maximum gap calculation unit calculates the maximum gap value based on the minimum value of the output value FB voltage extracted, with reference to the data indicating the relationship between the voltage value represented by the output value FB voltage and the maximum gap value. Thus, the accuracy of maximum gap value calculation is enhanced.

<Third Aspect>

According to a third aspect, the AC voltage calculation unit calculates the AC voltage value based on the maximum gap value calculated by the maximum gap calculation unit, with reference to data indicating a relationship between the maximum gap value and the AC voltage value.

According to the present aspect, the AC voltage calculation unit calculates the AC voltage value based on the maximum gap value, with reference to the data indicating the relationship between the maximum gap value and the AC voltage value. Thus, the accuracy of calculating the AC voltage value corresponding to the maximum gap value is enhanced.

<Fourth Aspect>

According to a fourth aspect, the AC voltage value calculated by the AC voltage calculation unit includes a threshold voltage to prevent formation of a defective image having a void.

According to the present aspect, the AC voltage calculation unit calculates, as the AC voltage value, the threshold voltage to prevent formation of the defective image having a void, preventing the image forming apparatus from forming such defective images with voids.

<Fifth Aspect>

According to a fifth aspect, the processor sequentially executes the minimum value extraction unit, the maximum gap calculation unit, and the AC voltage calculation unit, as a control process (e.g., control process B).

According to the present aspect, the processor sequentially executes the minimum value extraction unit, the maximum gap calculation unit, and the AC voltage calculation unit, as the control process, thereby generating and transmitting the output value control signal to the charging high-voltage power supply to control the charging high-voltage power supply such that the charging high-voltage power supply adjusts the charging bias. In particular, the charging bias is adjusted so as not to be excessively supplied to the photoconductor, thereby preventing formation of defective images. Accordingly, the charger uniformly charges the outer circumferential surface of the photoconductor with an appropriate charging bias to form reliable images.

<Sixth Aspect>

According to a sixth aspect, the processor executes the control process in response to a printing request.

According to the present aspect, the processor executes the control process in response to the printing request. For example, the processor executes the control process for each printing request to calculate an AC voltage value corresponding to the maximum gap value at the time. Accordingly, the image forming apparatus executes printing operation with an optimum charging bias of a DC voltage and an AC voltage superimposed on the DC voltage.

<Seventh Aspect>

According to a seventh aspect, the processor executes the control process in response to completion of printing.

According to the present aspect, the processor executes the control process in response to the completion of printing. For example, the processor executes the control process upon completion of printing, thereby reducing user waiting time.

<Eighth Aspect>

According to an eighth aspect, the processor executes the control process in response to power-on.

According to the present aspect, the processor executes the control process in response to power-on. Specifically, the processor executes the control process immediately after power-on, during refreshment operation that is different from image forming operation, thereby reducing the user waiting time.

<Ninth Aspect>

According to a ninth aspect, the processor executes the control process in response to recovery from an energy-saving status.

According to the present aspect, the processor executes the control process in response to the recovery from the energy-saving status. For example, the processor executes the control process immediately after energy-saving recovery and when the image forming operation is not performed, thereby reducing the user waiting time.

<Tenth Aspect>

According to a tenth aspect, the processor executes the control process in response to an elapse of a given period of time since previous execution of the control process.

According to the present aspect, the processor executes the control process in a case in which the given period of time has elapsed since the previous execution of the control process. For example, the processor executes the control process when the given period of time elapses to perform calculation without fluctuations in gap value.

<Eleventh Aspect>

According to an eleventh aspect, the image forming apparatus further includes a temperature and humidity sensor (e.g., temperature/humidity sensor 21) that measures temperature and humidity. The processor executes the control process in response to at least one of the temperature and the humidity measured by the temperature and humidity sensor changing by a given value or greater after previous execution of the control process.

According to the present aspect, the processor executes the control process in a case in which at least one of the temperature and the humidity measured by the temperature and humidity sensor has changed by the given value or greater after the previous execution of the control process. For example, in response to certain changes in temperature and humidity that may cause expansion of the charger and the photoconductor, the processor executes the control process, allowing the image forming apparatus to perform the image forming operation at appropriate voltage.

<Twelfth Aspect>

According to a twelfth aspect, an image forming apparatus (e.g., image forming apparatus 1) includes: a charger (e.g., charging roller 12); a photoconductor (e.g., photoconductor 6); and a charging high-voltage power supply (e.g., charging high-voltage power supply 18). A method for forming an image in the image forming apparatus includes a step of extracting a minimum value of an output value FB voltage based on the output value FB voltage generated by the charging high-voltage power supply in a given time. The output value FB voltage represents a voltage value corresponding to an output current value. The output current value is a value of an electric current output from the charger to the photoconductor. The photoconductor has an outer circumferential surface facing the charger via a gap (e.g., gap 43). The method further includes a step of calculating a maximum gap value, which is a value of a maximum gap distance between the photoconductor and the charger, based on the minimum value of the output value FB voltage extracted (step S50); calculating an AC voltage value based on the maximum gap value calculated (step S115); adding the AC voltage value calculated to a DC voltage value to generate an output value control signal; and transmitting the output value control signal to the charging high-voltage power supply to cause the charging high-voltage power supply to adjust and supply a charging bias to the charger. The charging bias includes a DC voltage and an AC voltage superimposed on the DC voltage.

Effects and advantages in the twelfth aspect is substantially the same as the effects and advantages in the first aspect.

<Thirteenth Aspect>

According to a thirteenth aspect, a non-transitory, computer-readable storage medium storing a computer-readable product that causes a processor (e.g., processor 24) to perform the method according to the twelfth aspect.

According to the present aspect, the computer-readable storage medium causes the processor to perform the image forming method including the steps described above.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

Each of the functions of the described embodiments may be implemented by one or more processing circuits or circuitry. Processing circuitry includes a programmed processor, as a processor includes circuitry. A processing circuit also includes devices such as an application-specific integrated circuit (ASIC), digital signal processor (DSP), field programmable gate array (FPGA) and conventional circuit components arranged to perform the recited functions.

Any one of the above-described operations may be performed in various other ways, for example, in an order different from that described above.

Further, any of the above-described devices or units can be implemented as a hardware apparatus, such as a special-purpose circuit or device, or as a hardware/software combination, such as a processor executing a software program.

Further, as described above, any one of the above-described and other methods of the present disclosure may be embodied in the form of a computer program stored on any kind of storage medium. Examples of storage media include, but are not limited to, floppy disks, hard disks, optical discs, magneto-optical discs, magnetic tapes, nonvolatile memory cards, read only memories (ROMs), etc.

Alternatively, any one of the above-described and other methods of the present disclosure may be implemented by an application-specific integrated circuit (ASIC), prepared by interconnecting an appropriate network of conventional component circuits or by a combination thereof with one or more conventional general-purpose microprocessors and/or signal processors programmed accordingly.

What is claimed is:

1. An image forming apparatus comprising:

a charger supplied with a charging bias including a direct current voltage and an alternating current voltage superimposed on the direct current voltage;

a photoconductor having an outer circumferential surface facing the charger via a gap;

a charging high-voltage power supply to supply the charging bias to the charger and generate an output value feedback voltage representing a voltage value corresponding to an output current value, the output current value being a value of an electric current output from the charger to the photoconductor; and circuitry configured to:

extract a minimum value of the output value feedback voltage based on the output value feedback voltage generated by the charging high-voltage power supply in a given time;

calculate a maximum gap value based on the minimum value of the output value feedback voltage extracted, the maximum gap value being a value of a maximum gap distance between the charger and the photoconductor;

calculate an alternating current voltage value based on the maximum gap value calculated;

add the alternating current voltage value calculated to a direct current voltage value to generate an output value control signal; and transmit the output value control signal to the charging high-voltage power supply to cause the charging high-voltage power supply to adjust the charging bias.

2. The image forming apparatus according to claim 1, wherein the circuitry calculates the maximum gap value based on the minimum value of the output value feedback voltage extracted, with reference to data indicating a relationship between the voltage value represented by the output value feedback voltage and the maximum gap value.

3. The image forming apparatus according to claim 1, wherein the circuitry calculates the alternating current voltage value based on the maximum gap value calculated, with reference to data indicating a relationship between the maximum gap value and the alternating current voltage value.

4. The image forming apparatus according to claim 3, wherein the alternating current voltage value calculated by the circuitry includes a threshold voltage to prevent formation of a defective image having a void.

5. The image forming apparatus according to claim 1, wherein the circuitry extracts the minimum value, calculates the maximum gap value, and calculates the alternating current voltage value sequentially as a control process.

6. The image forming apparatus according to claim 5, wherein the circuitry executes the control process in response to a printing request.

7. The image forming apparatus according to claim 5, wherein the circuitry executes the control process in response to completion of printing.

8. The image forming apparatus according to claim 5, wherein the circuitry executes the control process in response to power-on.

9. The image forming apparatus according to claim 5, wherein the circuitry executes the control process in response to recovery from an energy-saving status.

10. The image forming apparatus according to claim 5, wherein the circuitry executes the control process in response to an elapse of a given period of time since previous execution of the control process.

11. The image forming apparatus according to claim 5, further comprising a temperature and humidity sensor to measure temperature and humidity, wherein the circuitry executes the control process in response to at least one of the temperature and the humidity measured by the temperature and humidity sensor changing by a given value or greater after previous execution of the control process.

12. The image forming apparatus according to claim 1, wherein the charger and the photoconductor are maintained in a non-contact state.

13. The image forming apparatus according to claim 1, further comprising at least one roller that maintains the charger and the photoconductor in a non-contact state with the gap between the charger and the photoconductor.

14. A method for forming an image in an image forming apparatus, the image forming apparatus including a charger, a photoconductor, a charging high-voltage power supply, and circuitry, the method comprising:

extracting, with the circuitry, a minimum value of an output value feedback voltage based on the output value feedback voltage generated by the charging high-voltage power supply in a given time, the output value feedback voltage representing a voltage value corresponding to an output current value, the output current value being a value of an electric current output from the charger to the photoconductor, the photoconductor having an outer circumferential surface facing the charger via a gap;

calculating, with the circuitry, a maximum gap value based on the minimum value of the output value feedback voltage extracted, the maximum gap value being a value of a maximum gap distance between the charger and the photoconductor;

calculating, with the circuitry, an alternating current voltage value based on the maximum gap value calculated;

adding, with the circuitry, the alternating current voltage value calculated to a direct current voltage value to generate an output value control signal; and transmitting, with the circuitry, the output value control signal to the charging high-voltage power supply to cause the charging high-voltage power supply to adjust and supply a charging bias to the charger, the charging bias including a direct current voltage and an alternating current voltage superimposed on the direct current voltage.

15. A non-transitory, computer-readable storage medium storing computer-readable program code that causes a processor to perform a method for forming an image in an image forming apparatus, the image forming apparatus including a charger, a photoconductor, and a charging high-voltage power supply, the method comprising:

extracting a minimum value of an output value feedback voltage based on the output value feedback voltage generated by the charging high-voltage power supply in a given time, the output value feedback voltage representing a voltage value corresponding to an output current value, the output current value being a value of an electric current output from the charger to the photoconductor, the photoconductor having an outer circumferential surface facing the charger via a gap;

calculating a maximum gap value based on the minimum value of the output value feedback voltage extracted, the maximum gap value being a value of a maximum gap distance between the charger and the photoconductor;

calculating an alternating current voltage value based on the maximum gap value calculated;

adding the alternating current voltage value calculated to a direct current voltage value to generate an output value control signal; and transmitting the output value control signal to the charging high-voltage power supply to cause the charging high-voltage power supply to adjust and supply a charging bias to the charger, the charging bias including a direct current voltage and an alternating current voltage superimposed on the direct current voltage.

* * * * *